United States Patent [19]

Palmer

[11] 4,126,348

[45] Nov. 21, 1978

[54] UNIVERSAL HANDLING HEAD FOR A PIPE RACKER

[75] Inventor: Melvin J. Palmer, South Gate, Calif.

[73] Assignee: BJ-Hughes, Inc., Long Beach, Calif.

[21] Appl. No.: 794,003

[22] Filed: May 5, 1977

[51] Int. Cl.[2] ..... E21B 19/14

[52] U.S. Cl. ..... 294/88; 214/2.5; 294/90

[58] Field of Search ..... 294/86 A, 86.1, 88, 294/90, 102 A, 104, 106; 214/1 P, 2.5, DIG. 3

[56] References Cited

U.S. PATENT DOCUMENTS

| | | | |
|---|---|---|---|
| 1,021,984 | 4/1912 | Holmes | 294/90 |
| 2,537,607 | 1/1951 | Stone | 214/2.5 |
| 2,828,024 | 3/1958 | True | 214/2.5 |
| 3,063,509 | 11/1962 | Guier | 214/2.5 X |
| 3,561,811 | 2/1971 | Turner | 294/90 |
| 3,613,906 | 10/1971 | Deyo et al. | 214/2.5 |
| 3,937,514 | 2/1976 | Langowski | 294/90 X |
| 3,937,515 | 2/1976 | Langowski | 294/90 X |
| 4,030,746 | 6/1977 | Langowski | 214/2.5 X |

*Primary Examiner*—Johnny D. Cherry

*Attorney, Agent, or Firm*—Spensley, Horn & Lubitz

[57] ABSTRACT

A universal handling head which includes a lifting and/or a guiding head, for a pipe racker for handling pipe in a drilling derrick comprises a housing member and latch assembly having at least one latching finger. A latch assembly is engaged with the housing member to allow a latched finger to be placed in a left hand and right hand position with respect to the housing member. In one embodiment, the latch finger and latch assembly is rotated in the housing member in order to close on the pipe from both the left or the right sides. In another embodiment, the latch assembly has two latching fingers, a right and left latching finger, each of which may be translated as a unit by translating the latching assembly with respect to the housing member. The reversability of the latch finger by automated means allows the latch assembly to be positioned in such a manner as to facilitate closely spread pipe in a pipe racker.

13 Claims, 10 Drawing Figures

UNIVERSAL HANDLING HEAD FOR A PIPE RACKER

BACKGROUND OF THE INVENTION

1. Field of the Invention

The present invention is related to the field of oil well drilling equipment and in particular to drilling derricks having a pipe racker with left and right side racks and a handling head for lifting and/or guiding pipes within these racks.

2. Description of the Prior Art

More and more activity is being undertaken in the field of offshore deep water drilling. Floating platforms are generally used for deep water drilling and are subject to motion. For this reason it is necessary that pipe and drill collar handling equipment must be devised so that the pipe or drill collars may be positioned quickly and accurately in the well hole. In addition, pipe or drill collars must be racked in such a manner that they will be secure even when the platform, upon which the derrick is placed, rolls or pitches or is subjected to the force of the wind.

The pipe or drill collars are typically formed into a stand which consists of three sections of pipe or drill collar linked end to end. Each stand will then be picked up and manipulated by one or more handling heads to be positioned within a rack or moved to a position for connection to the drill string. The handling heads must therefore be able to securely grasp and lift the stand and accurately move the stand to the desired position within the pipe racker while the entire structure may be rolling or pitching in a rough sea. In the prior art, the handling heads have employed a latching finger, which when opened, would open to either the left or right side. In order to space the pipe closely, pipe or drill collars would be racked on the side which was opposite to the side on which the latching finger opened. Since the well head is positioned in the center of the derrick, the pipe racker is divided into a left and right half, one on each side of the center line of the derrick. Therefore, to store the stands in each half of the pipe racker, a left and right handed handling head was required. In the prior art, this necessitates carrying two separate handling heads on the drilling platform and necessitates a time consuming changeover which is usually manually performed.

In order to avoid the necessity of carrying two handling heads for each manipulating arm, when required, the prior art has devised a rotatable guide head whereby a left opening head may be unbolted, manually rotated and rebolted to form a right opening guide head. Again, this necessitated a time consuming manual operation. Moreover, the prior art rotatable guide heads were of such a design that after rotation, the center of the handling head was not positioned on the same axis in relation to the center of the derrick in the left hand configuration as it was in the right hand configuration.

Therefore, what is needed is a handling head which may be a guide or lifting head or which may be modified to encompass only a lifting or guide head, which may operate on both the left and right hand side of the pipe racker, and which may be automatically operated. Moreover, a universal handling head is needed, which when changed from left handed to right handed operation, or vice versa, will position the pipe on the same axis in relation to the manipulating and lifting arms so that automated or computer controlled racking of the stand in the left and right hand sides of the pipe racker may be accomplished without undue complication or adjustment due to changeover of the handling head.

SUMMARY OF THE INVENTION

The present invention is a universal handling head for a pipe racker which is comprised of a housing member and a latch assembly. A latch assembly has at least one latching finger and is engageably disposed in the housing member so that the latching finger may be displaced with respect to the housing member to at least a right and lefthand position. In both the right and lefthand positions the latching finger is so disposed with respect to the housing member that the pipe is centered at substantially the same point with respect to the housing member. When used as a guide head, the right and lefthand positions of the latching finger are configured and arranged to facilitate close spacing of the pipe in the left and right side of the pipe racker.

In one embodiment of the present invention the handling head is displaced with respect to the housing member by rotating the latch assembly with respect to the housing member. Rotation may be accomplished by a rotational actuator contained within the latch assembly or by an actuator which is coupled to a drive shaft by a chain belt.

Another embodiment of the present invention has two oppositely disposed latching fingers, i.e., a left opening finger and a right opening finger which are displaced with respect to the housing member by translating the latch assembly from a first to a second position.

In each case the handling head when used as a lifting head may embody an adjustable slide member disposed in the housing member. In addition an actuator is coupled to the sliding member to adjust the member to engage or disengage pipe held by the handling head.

BRIEF DISCUSSION OF THE DRAWINGS

DETAILED DESCRIPTION OF THE PREFERRED EMBODIMENTS

The present invention is a universal handling head which may be used to store stands of pipe or drill collars in a pipe racking system which may have pipe rackers on both sides of the drilling derrick. The head may be designed for use as a lifting head to lift the drill pipe and drill collar or as a guide head for drill pipe and drill collar for racking and casing the stands of pipe within the pipe racking system. The heads are arranged and configured such that the head fingers may be changed over from a left opening to a right opening finger, and vice versa, by an automated process without changing the axial position of the pipe which will be manipulated by the head. The operation and configuration of the present invention can be better understood by viewing the following figures.

Figure 1:
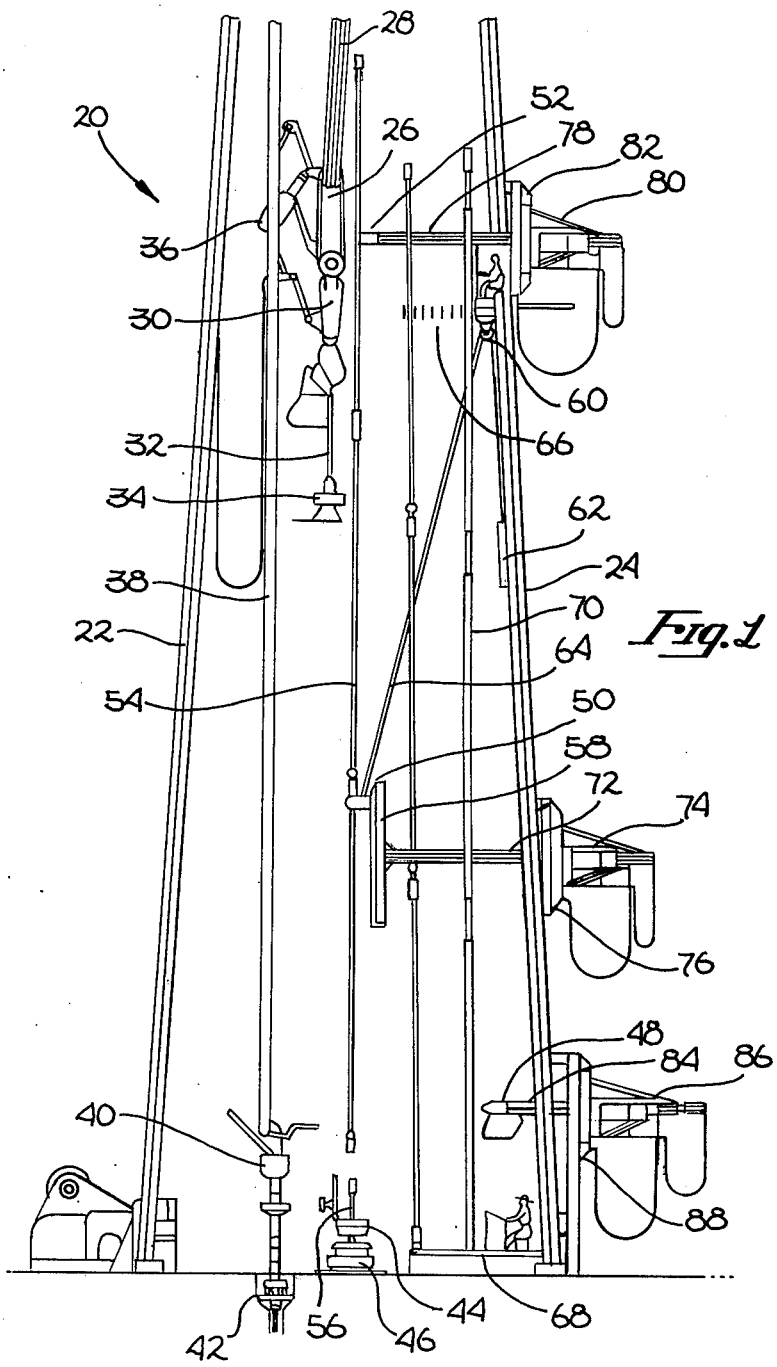
FIG. 1 is a diagrammatic side view of a drilling derrick having a single middle lifting head, a lower casing head, and an upper racking head.

In particular, FIG. 1 illustrates a diagrammatic side view of a drilling derrick 20. Derrick 20 typically has four vertically inclined corner legs two of which are illustrated as legs 22 and 24. A traveling block 26 is suspended by a wire line 28 from the upper portions of derrick 20 by appropriate apparatus. A hook 30 is suspended from the bottom of traveling block 26. A pair of links 32 are suspended from hook 30 to an elevator 34 (only one link being illustrated). A block and hook retractor 36 positions block 26 and hook 30 with respect to a tract 38 which extends vertically through derrick 20. The swivel and kelly assembly 40 is disposed in a rat hole 42. Also disposed on the base of derrick 20 is a set of power tongs 44 and power slips 46. Derrick 20 is illustrated as being fitted with three handling heads; namely, a lower head 48, a lifting head 50, and a guide head 52. Drill pipe 54 is shown as engaged by lifting head 50 and handling head 52 after having been separated from the drill pipe in hole 56 which drill pipe remains supported by power slips 46. Lifting head 50 has an adjustable slide member, which will be discussed in more detail below which engages the enlarged joint end of a section of drill pipe 54. Lifting head 50 is translated along the vertical direction on rack 58 by means of a sheave 60 and a lifting cylinder 62 which is coupled to lifting head 50 by means of wire line 64.

Drill pipe 54 will be moved from the center of derrick 20 to a position within a pipe finger board racking system 66. Finger board 66 is well known to the art. Once positioned within fingerboard 66, drill pipe 54 will be locked in the finger board 66, in the setback position 68 in the same manner as is shown for drill pipe 70.

Each of the handling heads has a retractable arm and a carriage. For example, lifting head 50 has a retractable arm 72 and a carriage 74 which is capable of translating arm 72 horizontally by means of horizontal translation of carriage 74 within frame 76. Thus, lifting head 50 may be positioned at any point within a horizontal plate parallel to the floor of derrick 20 by means of retractable arm 72 and carriage 74.

Racking head 52 is pinned to retractable arm 78. Arm 78 is coupled to carriage 80 which is free to translate within frame 82. Finally, casing head 48 is pinned to retractable arm 84 which in turn is coupled to carriage 85 within frame 88. Lifting head 50 is distinguished from racking head 52 and casing head 48 in that head 50 is engaged to a vertical rack 58 by means of a plurality of rollers which is described in greater detail below.

Figure 2:
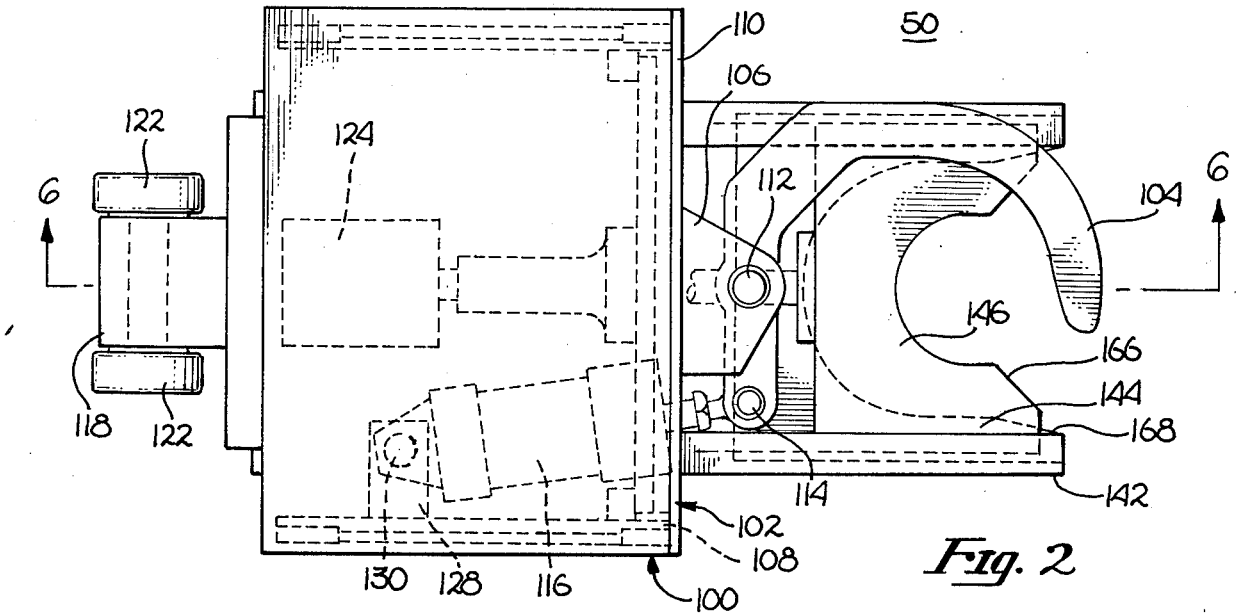
FIG. 2 is a top view of one embodiment showing a rotatable lifting head having a latching finger and an adjustable slide.
Figure 3:
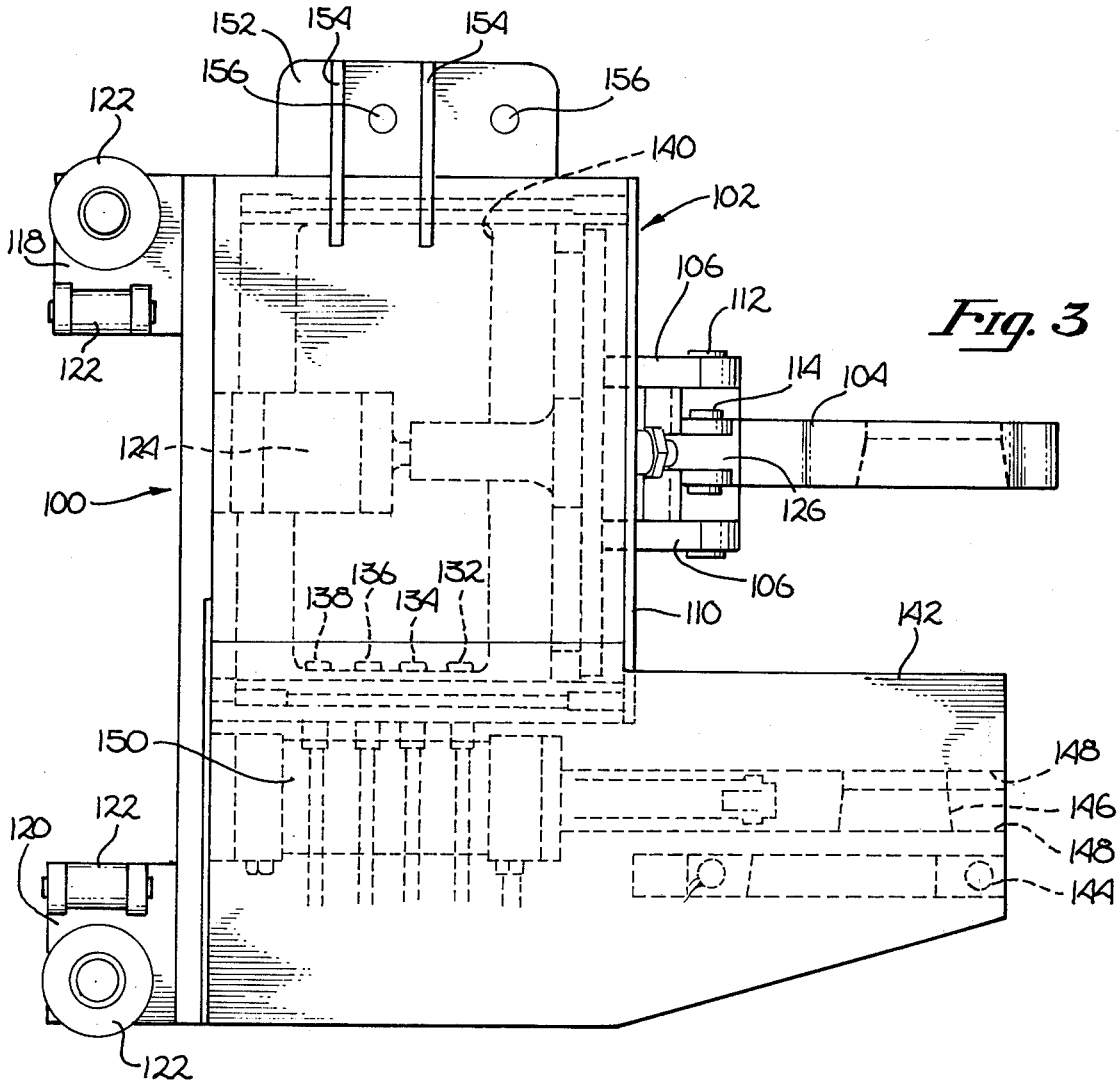
FIG. 3 is a side view of a rotatable handling head which more clearly shows the latching finger, adjustable slide and the actuators corresponding thereto.

The details of one embodiment of the handling head is illustrated by a top plan view shown in FIG. 2. The embodiment illustrated in FIG. 2 is a rotatable lifting head, which is shown only by way of example, and may also be used either for the racking or casing head by appropriate modifications well known to the art. Handling head or lifting head 50 is comprised of a cover or housing member, generally denoted by the reference character 100 and a rotatable latch assembly generally denoted by the reference character 102. Latch assembly 102 includes a latching finger 104 and a pivot member 106. A bearing member 108, which also forms part of latch assembly 102, is disposed within housing member 100 and is generally illustrated in FIG. 2 in phantom outline. Bearing member 108, has a face plate 110 from which pivot member 106 extends. A pivot 112 is fixed within pivot member 106 and extends through finger 104. A second pivot 114 extends through one end of finger 104 and provides a rotatable coupling between finger 104 and hydraulic latching cylinder 116, shown in phantom outline within housing member 100 and bearing member 108. The opposed end of cylinder 116 is rotatably coupled to bearing member 108 by means of a pivot 130 extending through a pivot member 128 which is fixed to a bearing member 108. Housing member 100 is extended at its rear plate to form extensions 118 and 120 (FIG. 3). These extensions are fitted with a plurality of rollers or followers 122, which in the case of lifting head 50 provide for rolling contact and engagement with rack 58 (FIG. 1).

A rotary actuator 124 is shown in phantom outline in FIG. 2 aligned and parallel to the center line of housing member 100 and has its axis extending through the center of the pivot pin 112. Actuator 124 is a pneumatic or hydraulic torque motor well known to the art, and provides a rotational force to bearing member 108 whereby finger 104 may be rotated from a first position, in which it is a left opening finger, to a second position in which it is a right opening finger. One end of actuator 124 is rigidly fixed to housing member 100 while the opposed end is rigidly fixed to face plate 110 of latch assembly 102.

The relationship of latch assembly 102 to housing member 100 may be better understood by viewing FIG. 3. FIG. 3 is a side view of the rotatable lifting head illustrated in FIG. 2. Pivot member 106 is shown as being a pair of extensions of latch assembly 102 extending from the face plate 110. Therefore, pivot 112 is securely retained in both the upper and lower portions of pivot member 106. Likewise, pivot pin 114 is retained at both of its ends by finger 104, while cylinder 116 engages pivot pin 114 about its center by means of a clevis 126. Cylinder 116 and actuator 124 are illustrated in phantom outline as contained within housing member 100. The end of cylinder 116 opposite to the pivot pin 114 is similarly engaged by pivot member 128. Cylinder 116 and actuator 124 are coupled by means of flexible hydraulic or pneumatic hoses (not shown for the sake of clarity) to a series of couplings 132, 134, 136, and 138. Couplings 132, 134, 136, and 138 are fixed to housing member 100 and extend therethrough and through an open sector 140 provided in bearing member 108. The actuator and cylinder each have a first and second port and a corresponding coupling attached to appropriate flexible hosing. Thus, fluid or air may be pumped through either the first or second port to affect the desired operation. In this manner finger 104 or latch assembly 102 may be opened, closed, or rotated depending upon the direction of fluid flow into cylinder 116 or actuator 124 respectively. Sector 140 of bearing member 108 is removed to allow through couplings 132, 134, 136, and 138 to extend into the interior of bearing number 108 and to allow the rotation of bearing member 108 through at least 180°.

In the embodiment where the handling head is used as a lifting head the lower portion of housing member 100 is extended to form a lifting yoke 142. Lifting member 142 includes a removable collar piece 144 and a slideable collar piece 146. Typically, removable collar piece 144 is bolted or fixed to lifting member 142 and has a larger diameter opening than slideable collar piece 146 (See FIG. 2). Slideable collar piece 146 is translated within member 142 within a groove or track 148 which is typically machined into member 142. Slideable collar piece 146 is translated along the length of track 148 by means of a pneumatic or hydraulic cylinder 150 which has one end rigidly coupled to housing member 100 and the opposed end rigidly coupled to slideable collar piece 146. In this manner lifting member 142, which is designed to bear the weight of the lifted stand, is adapted to handle drill pipe or drill collars of two different sizes without necessitating a manual changeover of collar pieces.

The lifting head as described may be used as a guide head as shown, or slideable collar piece 146 may be eliminated from the design and removable collar piece 144 may be eliminated and the lifting head used as a guide head.

At the top of housing member 100, opposite lifting member 142, is a lifting bracket 152 which may be welded to housing member 100 and reinforced by one or more transverse flanges 154. Lifting bracket 152 may have been provided with one or more holes 156 through which a wire line may be fitted and by which lifting head 50 may be vertically translated along a rack 58 by means of wire line 64.

Figure 4:
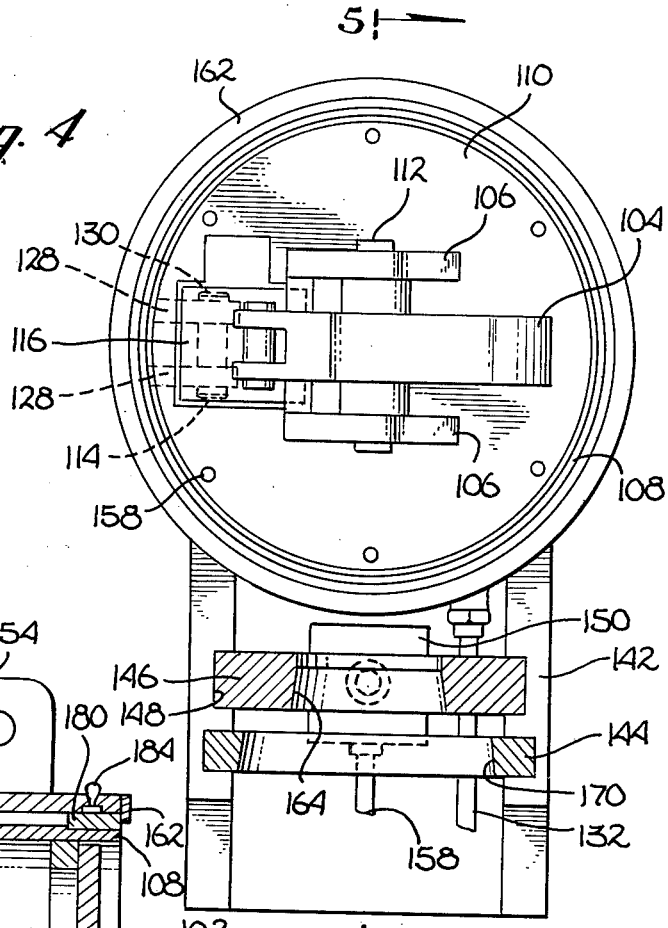
FIG. 4 is a front view of the embodiment of a rotatable lifting head shown in FIG. 2 showing the front portion of the bearing assembly within the housing member.

A front view of rotatable lifting head 50 is illustrated in FIG. 4. Circular facing plate 110 is shown as fixed to bearing member 108 by a plurality of bolts 158, although any other well known means of fixing face plate 110 to bearing member 108 may be used. The center of pivot 112 is clearly shown to be alligned with the center of face plate 110 or bearing member 108. The pivots 114 and 130, which are associated with actuator 116, may have their centers lying in a horizontal plane in common with the center of pivot 112. Pivot 130 and pivot members 128 are shown in phantom outline lying in FIG. 4 below the plane of face plate 110 and within bearing member 108. Housing member 100 has a retaining ring 162 which is concentric with face plate 110. The inner diameter of retaining ring 162 is less than the outer diameter of bearing member 108 so that the latch assembly and bearing member 108 is securely retained within housing member 100.

Lifting member 142 is clearly illustrated as having slideable collar piece 146 retained within track 148. Collar piece 146 may have a chamfered surface 164 and a flared end 166 (best shown in FIG. 2). Similarly, collar piece 144 is shown as rigidly fixed to lifting member 142 and also configured to have a chamfered surface 170 which may be flared at its end 168 (best seen in FIG. 2). Hydraulic coupling 132, which is the first of four couplings corresponding to cylinder 116 and actuator 124 within bearing member 108, is shown in FIG. 4 as extending beyond collar piece 144. Likewise, hydraulic coupling 158 which communicates with cylinder 150 is shown as extending beyond collar 144. The exact configuration and arrangement of the hyrdraulic couplings with respect to housing member 100 is not critical to the present invention and are shown only by way of example. These couplings may be arranged in any manner whatsoever with respect to housing member 100 as long as their placement is compatible with the rotation of bearing member 108.

Figure 5:
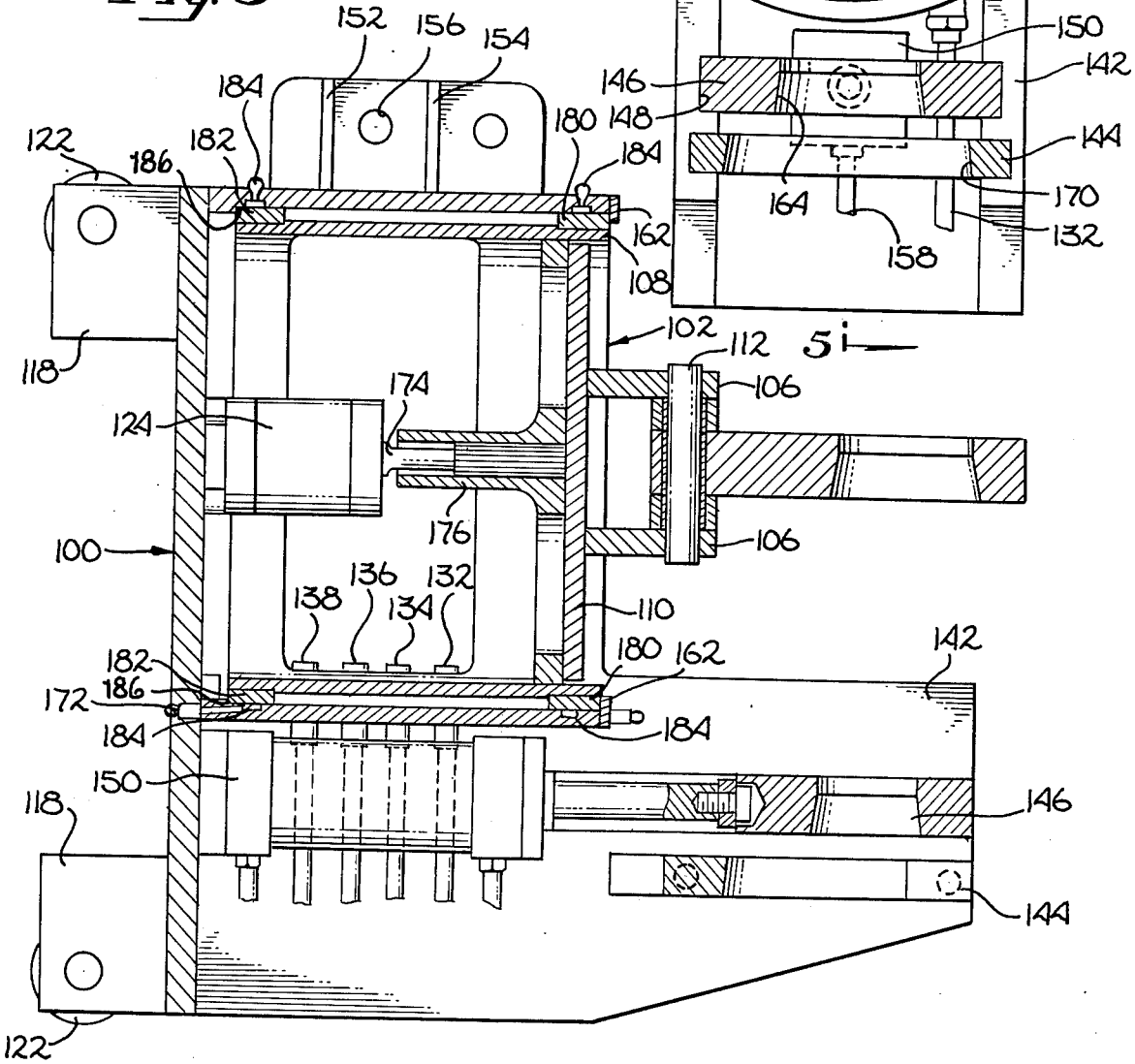
FIG. 5 is a cross section of the rotatable handling head taken through section 5 — 5 of FIG. 4.

A cross sectional view taken through lines 5—5 of FIG. 4 is illustrated in FIG. 5 and more clearly shows the internal structure of lifting head 50. Actuator 124 is fixed to housing member 100 along the center line of the latch assembly or bearing member 108. Actuator 124 imparts a rotary force by means of a shaft 174 which may be splined or keyed to a receiving fixture 176 fixed to the center of face plate 110. Sector 140 within bearing member 108 is clearly shown as permitting couplings 132, 134, 136, and 138 to extend into the interior of bearing member 108. Flexible hosing, which communicates the couplings with cylinder 116 and actuator 124, has been omitted for the sake of clarity. Front bearing ring 180 and rear bearing ring 182 of bearing member 108 is clearly shown in cross section. Bearing rings 180 and 182 serve as the only surfaces of contact between latch assembly 102 and the housing member 100. A grease groove 184 may be machined into the bearing surface of housing 100 opposed to the center line of bearing ring 180 and 182. One or more grease fittings 172 may communicate with grease groove 184 to permit the convenient and periodic lubrication of the bearing surfaces. Finally, the overlapping relationship between retaining ring 162 and bearing member 108, particularly front bearing ring 180, is clearly illustrated in the cross sectional view of FIG. 5. Rear bearing ring 182 is retained in position by means of a shoulder 186 formed in the adjacent portion of housing member 100. Therefore, bearing member 108 is securely retained within housing member 100 by means of slideable contact between retaining ring 162 and front bearing ring 180 and slidable contact between shoulder 186 and rear bearing ring 182.

Figure 6:
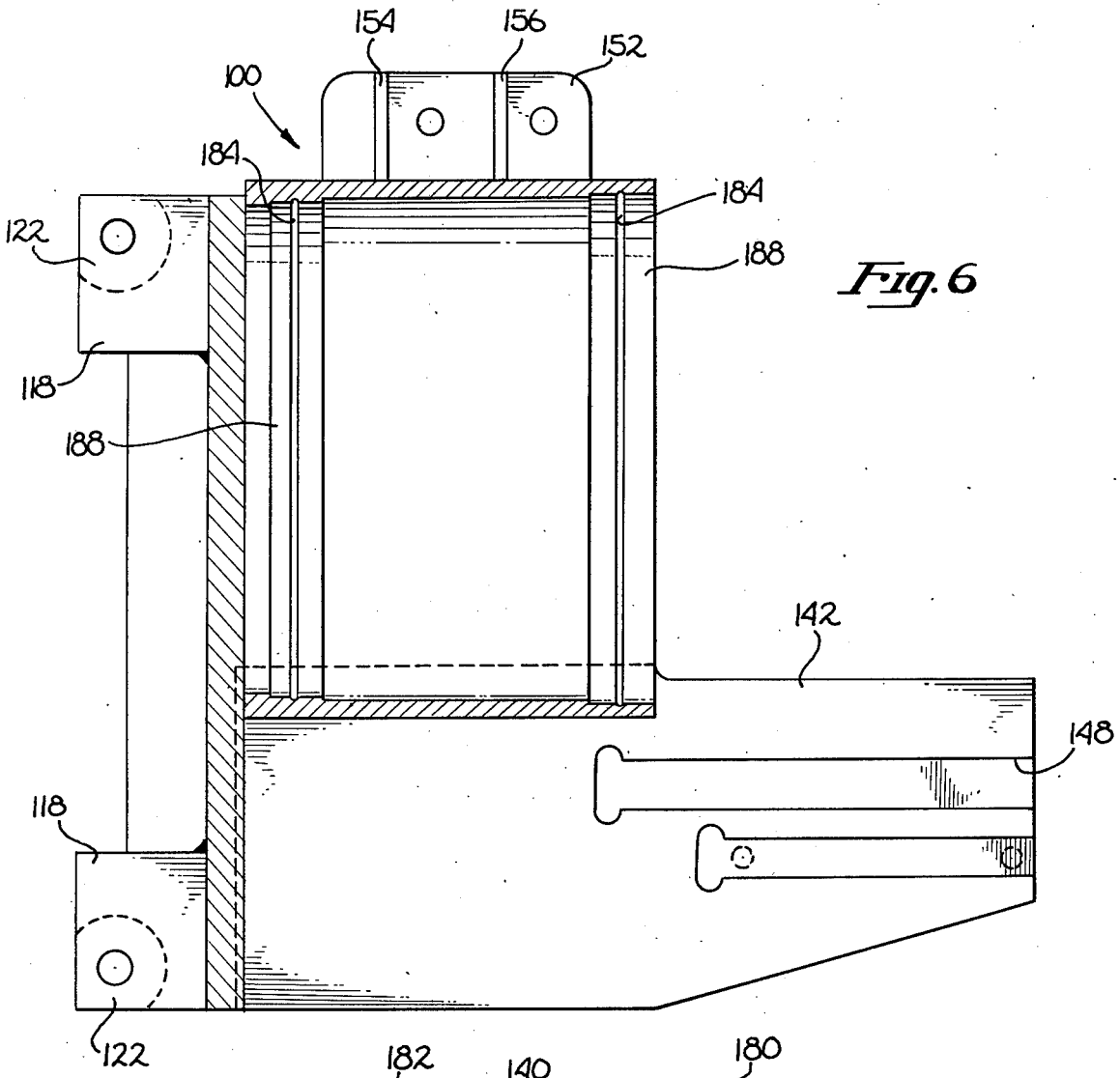
FIG. 6 is a side view of the housing member taken through section 6 — 6 of FIG. 2 showing the bearing surfaces within the housing member.

The details of housing member 100 are more simply illustrated in FIG. 6 which shows a cross sectional view of housing 100 through section 5 — 5 of FIG. 4 wherein the latch assembly, actuators, collar pieces, couplings, and other items have been removed for clarity. Grease groove 184 is shown as a machine groove running along the center line of bearing surfaces 188 formed in housing member 100.

Figure 7:
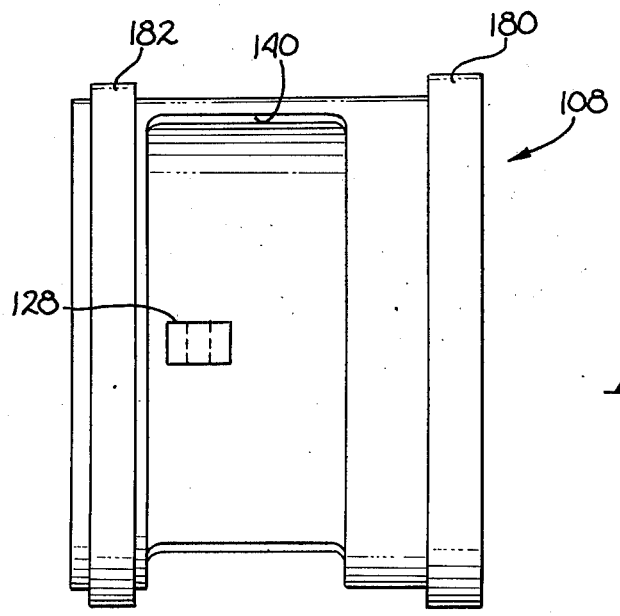
FIG. 7 is a side view of part of the latch assembly showing the bearing surfaces and configuration of the bearing member.

Configuration of bearing member 108 of the latch assembly is illustrated by means of a side view in FIG. 7. Bearing member 108 is comprised essentially of a drum having a cutaway open sector 140 through which couplings 132, 134, 136, and 138 extend and are coupled by means of flexible hosing to the actuator and cylinder contained within bearing member 108. Bearing rings 180 and 182 are formed at or near the ends of the drum forming the main portion of bearing member 108. Bearing rings 180 or 182 may be forged as an integral part of bearing member 108 or may be slip fit, welded, or fixed as separate pieces to the drum by any means well known to the art. The surfaces of bearing rings 180 and 182 may then be ground, polished, and finished by well known methods to form a hard, smooth and cylindrical bearing surface.

Figure 8:
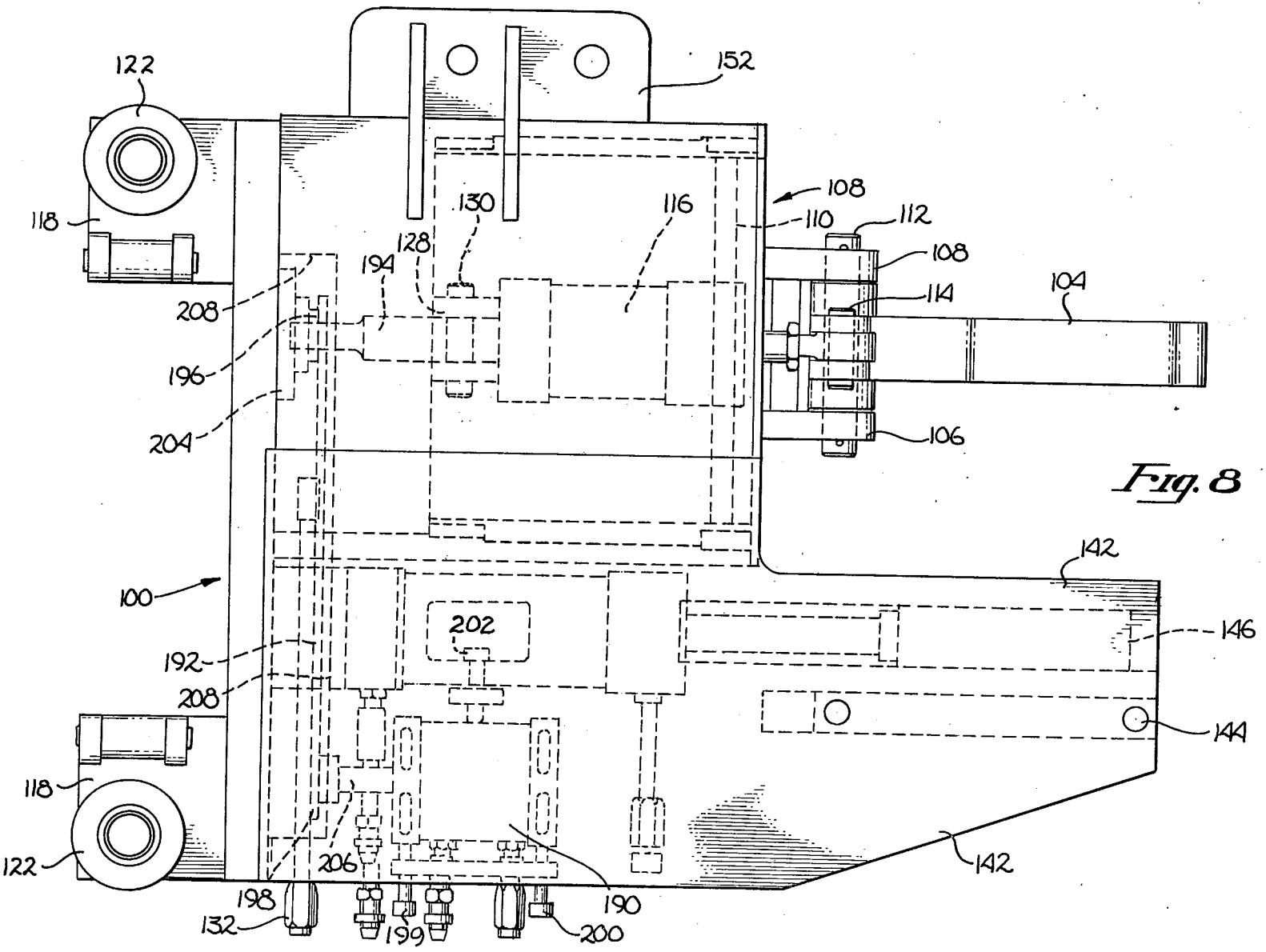
FIG. 8 is a side view of another embodiment of the rotatable handling head wherein an actuator disposed in the housing member drives the latch assembly by means of a sprocket and chain drive assembly.

Another embodiment of a rotatable head wherein the rotational actuator 124 is removed from the interior of bearing member 108 is illustrated in side view in FIG. 8. The embodiment of the lifting head illustrated in FIG. 8 is identical to the embodiment illustrated in FIGS. 2–7 with the exception that actuator 124 has been removed and replaced by a similar rotary actuator 190 which is positioned within a rear portion of lifting member 142. A solid, rigid drive shaft 194 is aligned along the center axis of bearing member 108 and is rigidly fixed by splines, keys, or other means well known to the art to the latch assembly or, in particular, face plate 110. The opposed end of drive shaft 194 is rigidly fixed to a sprocket 196. The sprocket end of drive shaft 194 is rotatably retained within a bearing mount 204 which is rigidly fixed to housing member 100. A similar sprocket 198 is fitted to the output shaft 206 of actuator 190. A continuous chain or belt 192 couples sprocket 196 with sprocket 198 thereby imparting the rotational force generated by actuator 190 to the latch assembly. Actuator 190 is held in place by set screws, 199, 200, and 202. By means of appropriate adjustment of set screws 199, 200, and 202, chain or belt 192 can be appropriately tensioned to insure secure engagement with the teeth of sprockets 196 and 198.

It is to be noted that bearing member 108 may be somewhat shortened in a rotatable head which incorporates a chain drive and that sector 140 may be omitted. In this case couplings 132 and 134 extend through housing 100 and communicate with cylinder 116 by means of flexible hosing through the open rear portion of bearing member 108. It is entirely possible that the embodiment of the rotatable head illustrated in FIGS. 2–7 may also incorporate a shortened bearing member 108 whereby the feed throughs and flexible hose couplings communicate with cylinder 116 and actuator 124 by entry through the rear portion of bearing member 108. The degree of which bearing member 108 may be shortened is limited by the physical dimensions of cylinder 116 together with pivot 130 and pivot member 128 which must be affixed to bearing member 108. In the embodiment illustrated in FIG. 8 bearing member 108 has been shortened to the greatest degree possible consistent with the physical dimensions of cylinder 116. In addition, sprockets 196 and 198 together with chain 192 may be entirely enclosed within cover 208 which is attached to housing number 100. In this manner flexible hose and other loose objects may be kept clear of sprockets 196 and 198, and chain 192.

Figure 9:
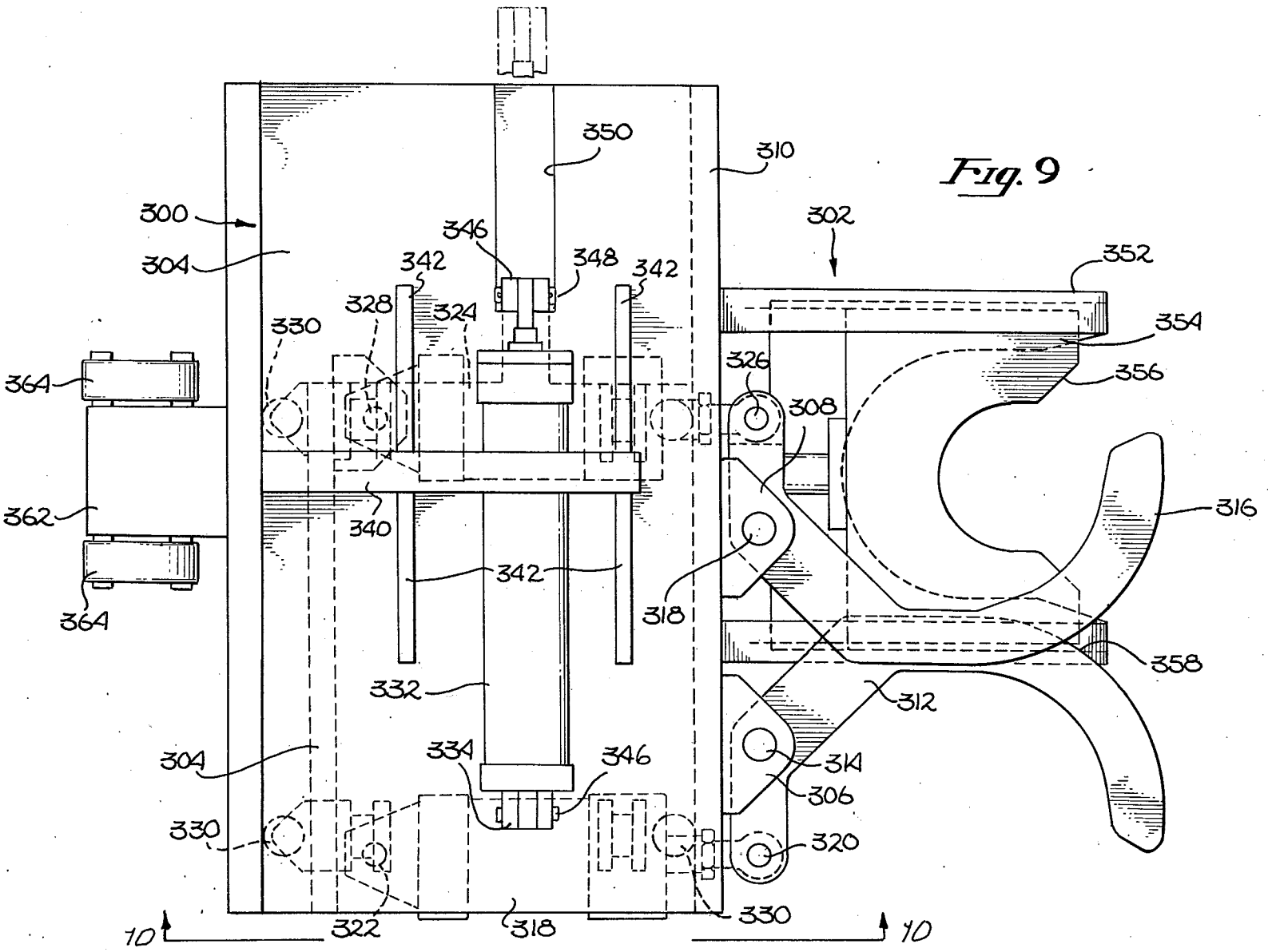
FIG. 9 is a top plan view of another embodiment of the present invention whereby the latch assembly incorporates a left opening and right opening latching finger which is translated by a traveling carriage with respect to a center line of the housing member.
Figure 10:
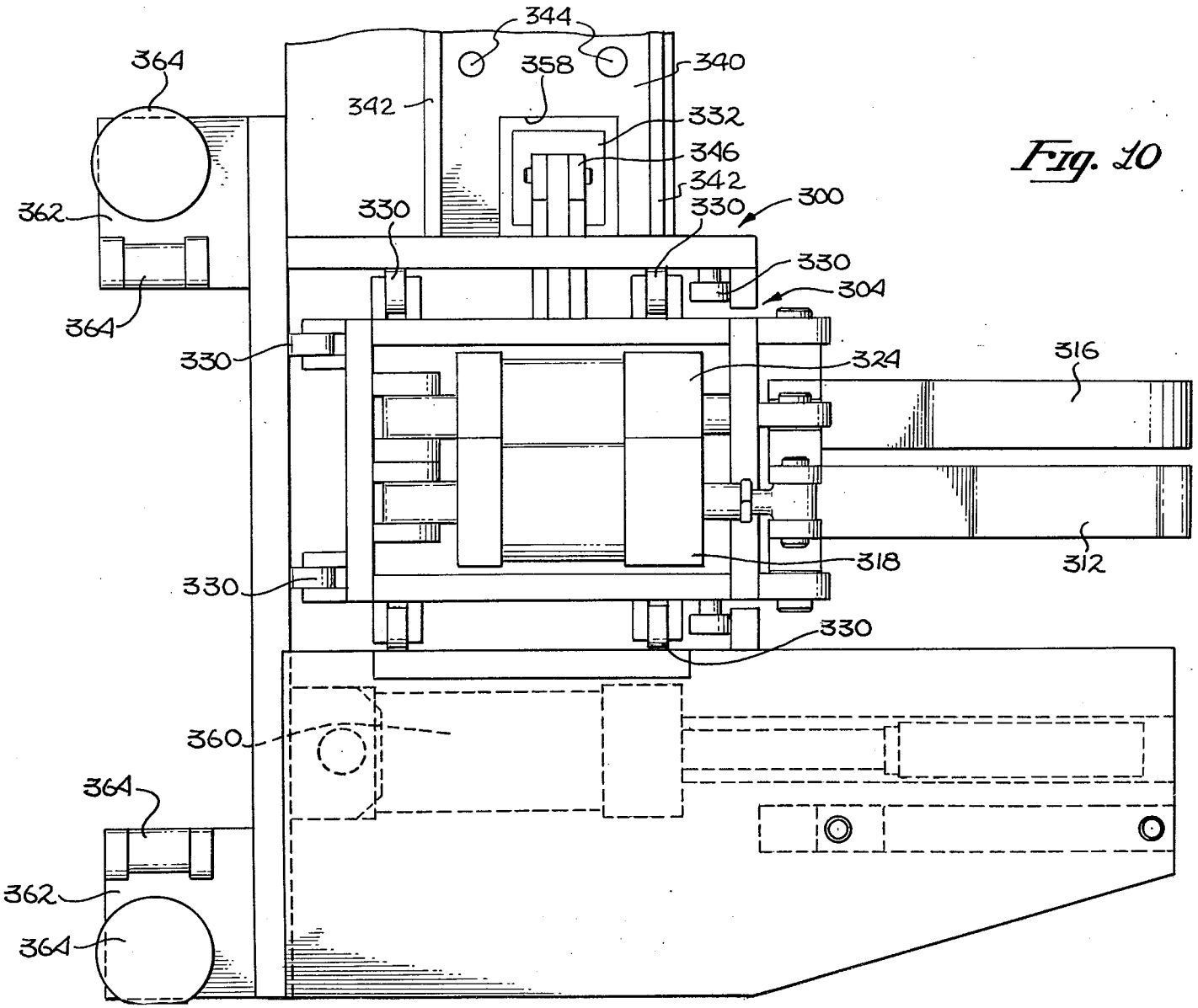
FIG. 10 is a side view of the embodiment illustrated in FIG. 9 showing the disposition of the latching fingers within the latching assembly.

Another embodiment of the universal head is illustrated in FIGS. 9 and 10. FIG. 9 is a top plan view of a handling head, similar in many respects to the rotatable head illustrated in FIGS. 2–8. However, in the embodiment of FIGS. 9 and 10, a double set of latch fingers are translated between a first and second position instead of being rotated. The lifting head of FIG. 9 is comprised of a housing member 300 and a latch assembly 302. The latch assembly is comprised of a traveling carriage 304 which is extended by two pairs of pivot members 306 and 308 from its facing plate 310. A right hand latching finger 312 is rotatably coupled to pivot member 306 by means of a pivot 314. A left hand latching finger 316 is similarly rotatably coupled to pivot member 308 by means of a pivot 318. As before, each latching finger 312 and 316 is activated by a pneumatic or hydraulic cylinder. Cylinder 318 is rotatably coupled to latching finger 312 by means of a rotatable coupling provided by pivot 320. The opposed end of cylinder 318 is similarly rotatably coupled to traveling carriage 304 by means of a pivot 322. Likewise, left hand latching finger 316 is rotatably coupled to cylinder 324 by means of pivot 326. The opposed end of cyliner 324 is rotatably coupled to traveling carriage 304 by means of pivot 328. Traveling carriage 304 is translated within housing member 300 by means of a plurality of indexing rollers 330 which may be best seen in FIG. 10.

Indexing cylinder 332 may be mounted exterior to and adjacent to the top portion of housing member 300 by means of a pivot member 334 and pivot pin 336. Indexing cylinder 332 may extend across the top portion of housing member 330 and through an aperture 338 provided in lifting bracket 340. Lifting bracket 340 is substantially similar to lifting bracket 152 of the embodiment illustrated in FIGS. 2–8 and includes at least one reinforcing perpendicular flange 342 and lifting holes 344. The movable end of cylinder 332 is rotatably coupled to an extension 346 of traveling carriage 304 by means of pivot 348. Extension 346 extends through a slot 350 provided in the top cover of housing member 300.

When used as a lifting head, the lower portion of housing member 300 may be extended to form a lifting member 352 which is substantially similar to the lifting member 142 of the embodiment illustrated in FIGS. 2–8. As before, lifting member 352 may be designed to carry the entire load of a stand of pipe which may be retained within the handling head. Lifting member 352 may be provided with a fixed collar piece 354 and a slideable collar piece 356 which is designed to engage a smaller diameter of pipe or drill collar than fixed collar piece 354. Slideable collar piece 356 is translated within a groove or track 358 provided in lifting member 352 by means of a pneumatic or hydraulic cylinder 360 (FIG. 10). Finally, housing member 300 may be fitted with extensions 362 which in turn are each fitted with a plurality of rollers or followers 364 which facilitate the translation of the handling head along rack 58 (shown in FIG. 1).

The operation of the slideable lifting head may be more easily visualized by referring to FIG. 10 which shows a cross section of the lifting head taken through section 10 — 10 of FIG. 9. Traveling carriage 304 is spaced from the top lower end in front walls of housing member 300 by means of the plurality of indexing rollers 330. Each roller is rotatably coupled to traveling carriage 304 by means of a pivot and a pivot member extending from the body of traveling carriage 304. Thus, it may be seen that traveling carriage 304 is rigidly secured within housing member 300 while being free to translate along a horizontal axis perpendicular to the center line of the handling head. Left hand latching finger 316 is illustrated as being disposed above the right hand latching finger 312. The relative position of latching fingers 312 and 316 is entirely a matter of convenience and may be reversed from the illustrated disposition without effecting the essential operation of the present invention. Couplings may be provided through the rear portion of lifting member 352, as previously, to deliver air or hydraulic fluid under pressure to cylinders 318, 324, and 360. As before, flexible hose may couple rigid couplings which may extend through housing member 300 to the appropriate cylinders. The flexible hose will then communicate the couplings with cylinders 318 and 324 by extending through a slot (not shown) provided in traveling carriage 304 or by extending through a lateral open end of traveling carriage 304.

It may be appreciated, that selectively activating cylinder 332 will position either a left hand latching finger 316 or right hand latching finger 312 with respect to the center line of lifting member 352 as desired. When the left hand latching finger 316 is appropriately positioned with respect to the center line of lifting member 352, the lifting head will be able to stack stands of pipe or drill collar on a pipe racker to the left of the handling head with a spacing as determined by the thickness of lifting member 352. Similarly, appropriately positioning right hand latching finger 312 with respect to the center line of lifting member 352 will permit high density stacking with respect to a pipe racker which is situated to the right of the handling head.

It can now be understood that by positioning pivot 112 of latch finger 104 of the embodiment of FIG. 2 in the center of a rotational bearing member 108, latch finger 104 may be changed from a left to a right opening finger, and vice versa, without changing the axis of pipe held by finger 104. This feature particularly adapts the present invention to automated or computer control which is a particularly advantageous feature in deep water drilling. This same beneficial feature is achievable using the embodiment illustrated in FIGS. 9 and 10.

It is to be understood, however, that alterations and modifications may be made both in the rotatable handling head and the sliding handling head by those having ordinary skill in the art without departing from the spirit and scope of the present invention.

I claim:

1. A handling head for handling drill pipe and drill collars in a pipe racker comprising:

a housing member; and a latch assembly having at least one latching finger, said latch assembly engageably disposed in said housing member to allow said latching finger to be displaced with respect to said housing member in a left and right hand configuration, said left and right hand configuration of said latching finger being arranged to facilitate close spacing of said pipe in said pipe racker;

wherein said latching finger is displaced with respect to said housing member by translating said latch assembly so that a first latch finger is translated from a first to a second position while a second latch finger is translated from a third to a fourth position, said first latch finger positioning said drill pipe and drill collars within said latch assembly at substantially the same point when in said first position as does said second latch finger when said second latch finger is in said fourth position.

2. The handling head of claim 1 wherein said latch assembly comprises:

a traveling carriage being disposed within said housing member, said traveling carriage extending beyond said housing member to form a first and second pivot member;

said first and second latch finger being rotatably coupled to said first and second pivot members respectively; and a first and second cylinder being rotatably coupled to said first and second latch fingers respectively, said first cylinder being coupled by a first pivot to said first latch finger and being rotatably coupled to said traveling carriage by a second pivot, said second cylinder being rotatably coupled to said second latch finger by a third pivot and being rotatably coupled to said traveling carriage by a fourth pivot, said first and third pivots forming a lever arm about the point of rotatable coupling of said first and second latch fingers, respectively, said first cylinder displacing said first and second pivots with respect to each other, said second cylinder displacing said third and fourth pivots with respect to each other to open and close said corresponding latch fingers. .

3. The handling head of claim 7 further comprising:

a plurality of roller means for engaging said traveling carriage within said housing member so that said traveling carriage may be translated therein; and a third cylinder rotatably coupled to said traveling carriage and said housing member to translate said traveling carriage with respect to said housing member.

4. The handling head of claim 1 wherein said housing member includes:

an adjustable lifting member disposed in said housing member; and a cylinder to adjust said lifting member to selectively engage and disengage said drill pipe and drill collars.

5. In a drilling derrick having a pipe racker, handling head to place drill pipe and drill collars in said rack comprising:

a housing member;

a rotatable latch assembly having a latching finger, said latch assembly being rotatably disposed in said housing member to permit said latching finger to be rotated at least 180 degrees between a left and right hand configuration said latching finger retaining said drill pipe and drill collar in substantially the same position whether said latching finger is in said left or right hand configuration;

a first cylinder being disposed in said latch assembly and being coupled to said latching finger to selectively open and close said latching finger; and a rotary actuator being fixed with respect to said housing member and being coupled to said latch assembly to selectively rotate said latch assembly substantially at least 180° with respect to said housing member.

6. In a drilling derrick having a pipe racker, handling head to place drill pipe and drill collars in said racker comprising:

a housing member;

a rotatable latch assembly having a latching finger, said latch assembly being rotatably disposed in said housing member to permit said latching finger to be rotated approximately 180° between a left and right hand configuration, said latching finger retaining said drill pipe and said drill collar in substantially the same position whether said latching finger is in said left or right hand configuration;

a first cylinder being disposed in said latch assembly and being coupled to said latch finger to selectively open and close said latching finger; and a rotary actuator being disposed on the axis of rotation of said latch assembly and being coupled to said latch assembly by a rigid member to selectively rotate said latch assembly with respect to said housing member.

7. The handling head of claim 6 wherein said rotatable latch assembly comprises:

a bearing assembly rotatably engaging said housing member and extending beyond said housing member to form a pivot member;

said latching finger being rotatably coupled to said pivot member by a first pivot;

said first cylinder being rotatably coupled to said latching finger by a second pivot disposed on said latching finger to form a lever arm through said first pivot, said first cylinder also being rotatably coupled to said bearing assembly by a third pivot, said first cylinder displacing said second pivot with respect to said third pivot to open and close said latching finger.

8. The handling head of claim 7 wherein said first pivot is centered on the axis of rotation of said bearing assembly.

9. In a drilling derrick having a pipe racker, a handling head to place drill pipe and drill collars in said racker comprising:

a housing member;

a rotatable latch assembly having a latching finger, said latch assembly being rotatably disposed in said housing member to permit said latching finger to be rotated approximately 180° between a left and right hand configuration, said latching finger retaining said drill pipe and drill collar in substantially the same position whether said latching finger is in said right or left hand configuration;

a first cylinder being disposed in said latch assembly and being coupled to said latching finger to selectively open and close said latching finger; and a rotary actuator being disposed outside of said latch assembly and being coupled to a rigid member by a flexible belt, said rigid member being rotatably coupled to said housing member and rigidly fixed to said latch assembly on the axis of rotation of said latch assembly to selectively rotate said latch assembly with respect to said housing member.

10. In a drilling derrick having a pipe racker, a handling head to place drill pipe and drill collars in said racker comprising:

a housing member;

a traveling carrige, being slideably disposed with respect to said housing member, a first and second latching fingers being coupled to said traveling carriage and being substantially identical in shape and being oppositely oriented with respect to said traveling carriage to engage said drill pipe and drill collar by said first finger when said traveling carriage is in a first position and to engage said drill pipe and drill collar by said second finger when said traveling carriage is in a second position; and a first and second cylinder having one end coupled to said first and second latching fingers respectively, and having a second end coupled to said traveling carriage to selectively open and close said latching fingers;

11. The handling head of claim 10 wherein said housing member includes:

an adjustable lifting member; and a third cylinder to adjust said lifting member to engage and disengage said drill pipe and drill collar.

12. The handling head of claim 10 further comprising:

a translation cylinder to selectively dispose said traveling carriage in said first and second positions, said translation cylinder coupled between said housing member and said traveling carriage.

13. The handling head of claim 10 wherein said drill pipe and drill collar are positioned in substantially the same location with respect to said drilling derrick when said traveling carriage is in said first position as when in said second position.

* * * * *